US005675345A

United States Patent [19]

Pozgay et al.

[11] Patent Number: 5,675,345

[45] Date of Patent: Oct. 7, 1997

[54] COMPACT ANTENNA WITH FOLDED SUBSTRATE

[75] Inventors: Jerome H. Pozgay, Medford; James D. Birch, Townsend; Eileen Conaty, Methuen, all of Mass.; Daniel L. Fontaine, Hudson, N.H.; Henry M. Majchrzak, Burlington, Mass.

[73] Assignee: Raytheon Company, Lexington, Mass.

[21] Appl. No.: 561,513

[22] Filed: Nov. 21, 1995

[51] Int. Cl.[6] ..... H01Q 1/38

[52] U.S. Cl. ..... 343/700 MS; 343/754

[58] Field of Search ..... 343/700 MS, 753, 343/754, 702, 909

[56] References Cited

U.S. PATENT DOCUMENTS

| | | | |
|---|---|---|---|
| 3,761,936 | 9/1973 | Archer et al. | 343/754 |
| 3,964,069 | 6/1976 | Mcdonough | 343/754 |
| 3,979,754 | 9/1976 | Archer | 343/754 |
| 4,063,245 | 12/1977 | James et al. | 343/700 MS |
| 4,072,951 | 2/1978 | Kaloi | 343/700 |
| 4,180,817 | 12/1979 | Sanford | 343/700 |
| 4,490,723 | 12/1984 | Hardie et al. | 343/754 |
| 4,686,535 | 8/1987 | Lalezari | 343/700 |
| 4,800,392 | 1/1989 | Garay et al. | 343/702 X |
| 4,806,941 | 2/1989 | Knochel et al. | 343/700 MS |
| 4,843,403 | 6/1989 | Lalezari et al. | 343/767 |
| 4,907,006 | 3/1990 | Nishikawa et al. | 343/700 |
| 5,014,070 | 5/1991 | Stock et al. | 343/754 X |

*Primary Examiner*—Donald T. Hajec
*Assistant Examiner*—Tho Phan
*Attorney, Agent, or Firm*—Donald F. Mofford

[57] ABSTRACT

An antenna having: a beam forming network; an array of antenna elements; and a parallel plate region coupling the array of antenna elements and the beam forming network formed on a common, folded dielectric substrate. The beam forming network includes strip conductor circuitry separated from a ground plane conductor by a portion of the substrate. The array of antenna elements comprising strip conductor circuitry separate from a ground plane conductor by a second portion of the substrate. The parallel plate region is disposed about a folded region of the substrate and includes a pair of conductive plates separated by the folded region of the substrate. With such arrangement, a compact antenna is provided using the folded substrate. Also, spurious radiation (which has been found to radiate when strip conductor circuitry is disposed about the folded region to couple the array of antenna elements and the beam forming network) is confined by the parallel plate region.

30 Claims, 4 Drawing Sheets

COMPACT ANTENNA WITH FOLDED SUBSTRATE

BACKGROUND OF THE INVENTION

This invention relates generally to radio frequency antennas and more particularly to compact radio frequency antennas.

As is known in the art, radio frequency antennas have a wide range of applications. In one type of antenna, a beam of radiation thereof is directed along a desired direction by physically positioning the boresight axis along the desired direction. In another type of antenna, a beam forming network is coupled to an array of antenna elements and the beam forming network provides a relative phase shift across the array of antenna elements to produce a radiation pattern in the desired direction. One type of beam forming network may include an input/output port coupled to the array of antenna elements through a network of controllable phase shifters. In another type, the beam forming network includes a plurality of input/output ports, each one thereof being associated with a differently directed beam of radiation. One of this latter type of beam forming network includes a Rotman/Turner microwave lens and is described U.S. Pat. No. 3,761,936. Multi-Beam Array Antenna", inventors D. H. Archer et al., issued Sep. 25, 1973, assigned to the same assignee as the present invention.

While such antennas are useful in many applications, in other applications it is necessary that the antenna be compact and inexpensive.

As is also known in the art, in many applications the array of antenna elements include a series of patch type radiating elements. One example of an array of patch radiating elements is described in U.S. Pat. No. 4,686,535 "Microstrip Antenna System with Fixed Beam Steering For Rotating Projectile Radar System", inventor Lalazari, issued Aug. 11, 1987. The type of patch radiating element described in such U.S. Pat. No. 4,686,535 is a terminating resonant patch radiator. The common concept of the patch radiator is that the radiation mechanism is an interruption of the radio frequency (RF) current by an abrupt discontinuity in the RF current. These discontinuities are considered by some to be elements in a resonant structure in which the patch is a resonant termination of the feed line or in a series resonant structure. While such patch radiators provide linear polarization, in some applications it is necessary that the antenna provide circular polarization.

SUMMARY OF THE INVENTION

In accordance with the present invention, an antenna is provided having: a beam forming network; an array of antenna elements; and a parallel plate region coupling the array of antenna elements and the beam forming network formed on a common, folded dielectric substrate. The beam forming network includes strip conductor circuitry separated from a ground plane conductor by a portion of the substrate. The array of antenna elements comprise strip conductor circuitry separated from a ground plane conductor by a second portion of the substrate. The parallel plate region is disposed about a folded region of the substrate and includes a pair of conductive plates separated by the folded region of the substrate.

With such arrangement, a compact antenna is provided using the folded substrate. Also, spurious radiation (which has been found to radiate when strip conductor circuitry ts disposed about the folded region to couple the array of antenna elements and the beam forming network) is confined by the parallel plate region.

In accordance with another feature of the invention the beam forming network is a microwave lens having a plurality of array ports disposed along one edge thereof and a plurality of beam ports disposed along an opposite edge of the lens, each one of the beam ports being associated with a differently directed one of a plurality of beams, the electrical lengths between each point on a wavefront of such beam, through the array of antenna elements, the parallel plate region and the microwave lens to the one of the beam ports associated therewith, being electrically equal to each other.

In accordance with another feature of the invention the beam forming network includes a plurality of microstrip transmission lines coupling the array ports to one end of the parallel plate region. The array of antenna elements includes a plurality of microstrip transmission lines coupled to an opposite end of the parallel plate region. In one preferred embodiment of the invention, the substrate is U-shaped and in another preferred embodiment of the invention the substrate is L-shaped. In the U-shaped embodiment, the ground plane conductors of the beam forming network and the array of antenna elements comprise a single conductor disposed on the inner surface of the U-shaped substrate and the strip conductor circuitry of the antenna elements and the beam forming network are disposed on the outer surface of the U-shaped substrate. The ground conductor also provides one of the plates for the parallel plate region.

In the L-shaped substrate embodiment, the ground plane conductor of the beam forming network and the ground plane conductor of the array of antenna elements are disposed on opposite surfaces of the L-shaped substrate and the strip conductor circuitry of the antenna elements and the beam forming network are disposed on the opposite surfaces of the L-shaped substrate. In both embodiments, a ground plane conductor is disposed between the feed network and the array of antenna elements.

With such arrangement, the beam forming network is shielded from the antenna element by the ground plane.

In accordance with still another feature of the invention, a microwave lens antenna is provided having: a microwave lens element; an antenna element; a ground plane conductor disposed between the microwave lens element and the antenna element; a dielectric having disposed thereon the ground plane conductor, the microwave lens element, and the antenna element.

With such arrangement, the lens element is shielded from the antenna element by the ground plane.

In a preferred embodiment, the parallel plate region comprises a portion of the ground plane conductor and a second conductor disposed on a second, opposite surface of the substrate. The ground plane conductor provides a ground plane for the array of antenna elements and portions of the second conductor providing a ground plane for the microwave lens element.

DESCRIPTION OF THE PREFERRED EMBODIMENTS

Figure 1B:
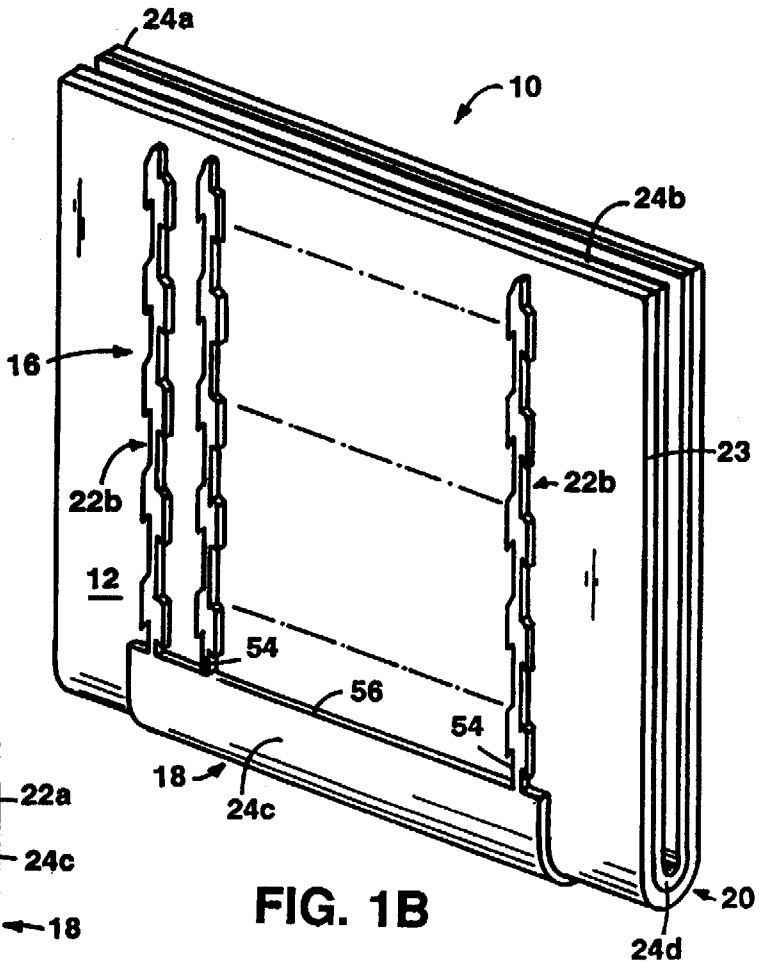
FIG. 1B if isometric sketch of the antenna of FIG. 1A from a front perspective of such antenna.
Figure 1C:
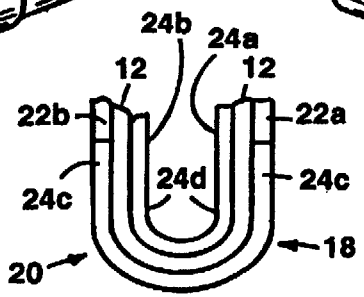
FIG. 1C is an exploded view of a folded portion of the antenna of FIGS. 1A and 1B, such portion being enclosed by dotted line 1C in FIG. 1A.
Figure 1A:
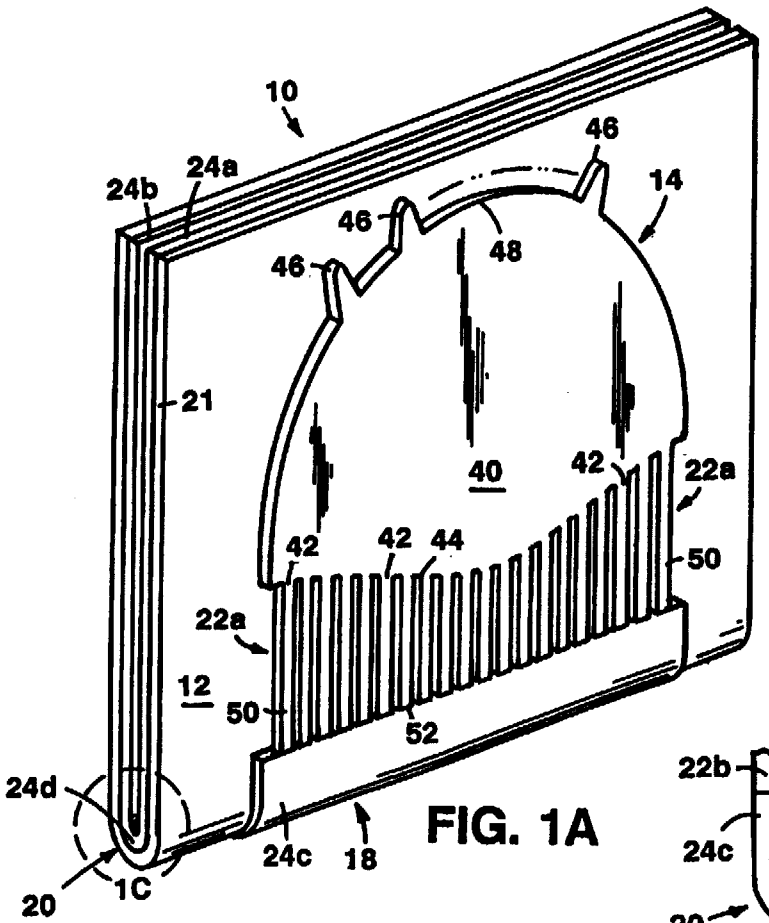
FIG. 1A is a isometric sketch from a rear perspective of antenna according to the invention.

Referring now to FIGS. 1A and 1B, an antenna 10 is shown having: a beam forming network 14; an array of antenna elements 16; and a parallel plate region 18 coupling the array of antenna elements 16 and the beam forming network 14, all formed on a common, folded dielectric substrate 12. The beam forming network 14 includes strip conductor circuitry 22*a*separated from a ground plane conductor 24*a* by a rear portion 21 of the substrate 12. The array of antenna elements 16 includes strip conductor circuitry 22*b* separated from a ground plane conductor 24*b* by a front portion 23 of the substrate 12. The parallel plate region 18 is disposed about a folded region 20 of the substrate 12 and includes a pair of conductive plates 24*c*, 24*d* (FIG. 1C) separated by the folded region of the substrate 12. Here, the dielectric substrate 12 is U-shaped with the ground plane conductors 24*a*, 24*b*, 24*d* being a single conductive sheet clad to the inner surface of the U-shaped substrate 12. The strip conductor circuitry 22*a*, 22*b* and plate 24*c* are etched into a conductor clad onto the outer surface of the U-shaped substrate 12. Thus, the portion 24*d* of the ground plane conductor 24 disposed about the inner portion of the folded region of substrate 12 provides one of the two parallel plates of the parallel plate region 18. Conductor 24*c* provides the other one of the plates for the parallel plate region 18. The strip conductor circuitry 22*a* of the beam forming network 14 and the strip conductor circuitry 22*b* of antenna elements 16, the ground plane conductor 24 thereof and the conductive plate 24*c* of the parallel plate region 18 are formed using conventional printed circuit, photo-lithographic chemical etching processes.

Here, the beam forming network 16 is a microwave lens having a lens element 40 printed on the outer surface of substrate 12. A plurality of array ports 42 is disposed along one edge 44 thereof and a plurality of beam ports 46 are disposed along an opposite edge 48 of the lens element 40. Each one of the beam ports 46 is associated with a differently directed one of a plurality of beams. The electrical lengths between each point on a wavefront of such beam, through the array of antenna elements, the parallel plate region and the microwave lens to the one of the beam ports associated therewith, being electrically equal to each other.

The beam forming network 14 includes a plurality of microstrip transmission lines 50 coupling the array ports 42 to one end 52 of the parallel plate region 18. The array of antenna elements 16 includes a plurality of microstrip transmission lines 54 coupled to an opposite end 56 of the parallel plate region 18. The ground plane conductors 24*a*, 24*b* of the beam forming network 14 and the array of antenna elements 16 comprise a single conductor, here ground plane conductor 24. The ground plane conductor 24 is disposed on the inner surface of the U-shaped substrate 12. The strip conductor circuitry 22*b* of the antenna elements 16 and the beam forming network 14 are disposed on the outer surface of the U-shaped substrate 12, as described above.

Figure 2:
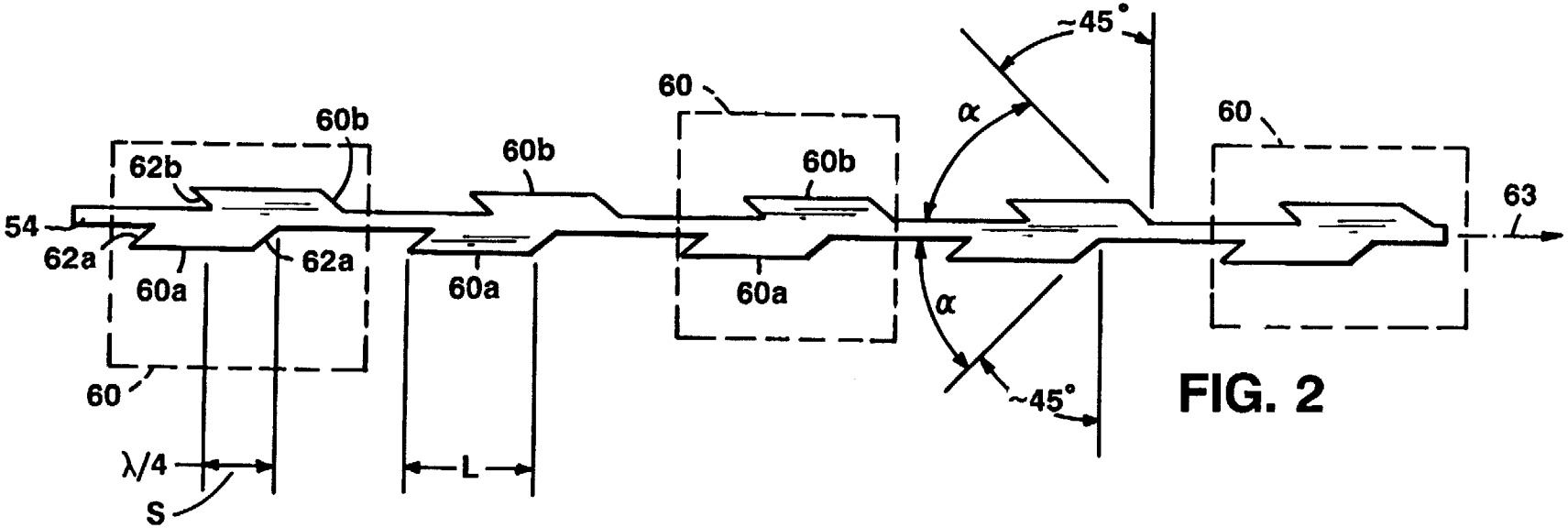
FIG. 2 is a plan view of strip conductor circuitry forming one element of an array of antenna elements according to the invention and adapted for use in the antenna of FIGS. 1A and 1B.

The antenna elements 16 are of the same configuration. The strip conductor circuitry 22*b* of an exemplary one thereof is shown in FIG. 2. Thus, the antenna element includes a microstrip transmission line having two series of conductive patches 60*a*, 60*b*, respectively. Here each patch is rhomboidal shaped. More particularly, the patches 60*a* have edges disposed at an oblique angle, $\alpha$, here substantially forty-five degrees, with respect to the microstrip transmission line and patches 60*b* have edges disposed at an oblique angle, $-\alpha$, here substantially negative forty-five degrees. Thus, the edges of one of the patches 60*a* are at substantially ninety degrees to the edges of the other one of the patches 60*b*.

Thus, as shown in FIG. 2, each patch radiating element 60 is made up of a microstrip transmission line 54 having a series of pairs of contiguous patches 60*a*, 60*b*, (i.e., each one of the radiating elements has a pair of conductive patches). Each one of the patches is disposed on opposite edges of the transmission line. Each of the patches has edges disposed at an oblique angle, here substantially +/− forty-five degrees, with respect to the microstrip transmission line. Further, one patch in each patch radiating element is staggered with respect to the other patch in the radiating element along the transmission line by substantially a quarter-wave length at the nominal operating wavelength of the transmission line. That is the center-to-center spacing, S, between the pair of staggered patch elements 60*a*, 60*b* making up a patch radiating element 60 are separated by $\lambda/4$, where $\lambda$ is the nominal operating wavelength of the antenna element.

It should be noted that patches 60*a* may be conventional rectangular patches. Here, however, the patches are rhomboidal shaped to produce a circular polarized beam of radiation. More particularly, and referring first to FIG. 3, a series of rhomboidal shaped patches 60' and a transmission line 54' therefor, are shown. At a series discontinuity, the electric field is normal to the underlying ground plane conductor, not shown, and such electric field is also normal to the conductive edge of the patch. Thus, here because the edges 62' of each one of the patches are skewed, here by $\alpha$, with respect to the direction 63 of the transmission line 54', in spatial directions normal to the plane of the antenna the far electric field produced by the abrupt, tilted (by $\alpha$) discontinuity will be polarized in a plane which is nearly perpendicular to the radiation edge. Therefore, a slant (by $\alpha$) polarization is achieved. It should be noted that the tilt of the electric field relative to the plane containing the array axis will generally be less than the tilt of the edge discontinuity due to the mutual coupling between adjacent ones of the patches.

Figure 4:
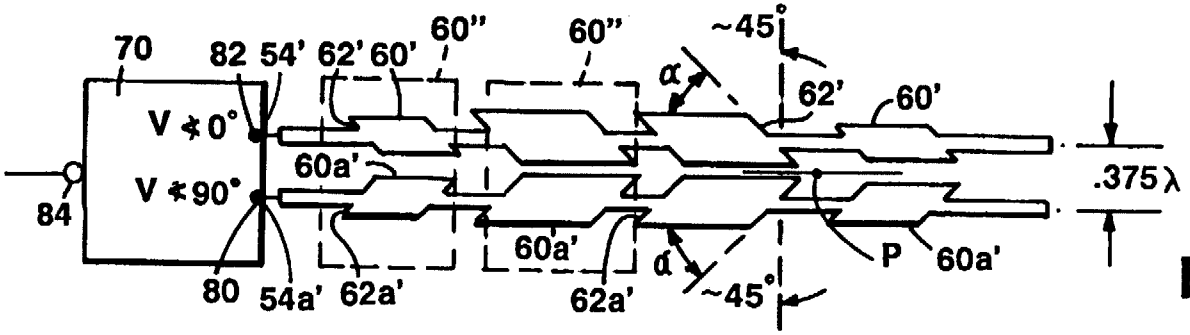
FIG. 4 is a plan view of strip conductor circuitry forming one element of an array of antenna elements according to an another alternative embodiment of the invention and adapted for use in the antenna of FIGS. 1A and 1B according to the invention.

For an electrically large antenna aperture, the width of the patch 60' will typically be less than two widths of the interconnecting high impedance transmission line 54'. Thus, as shown in FIG. 4, a pair of side-by-side radiators 60" which produce orthognal linear polarizations, when coupled to a ninety degree phase combiner/divider 70 is able to provide a circular polarized radiation pattern. The second microstrip transmission line 54*a'* has a series conductive patches 60*a'*, such patches 60*a'* having edges 62*a'* disposed at an oblique angle, here +/− forty-five degrees with respect to the edges 62' of the patches 60'. The edges 62' of the patches 60' are disposed at substantially ninety degrees with respect to the edges 62a' of the second series of patches 60a'. The transmission line 54' and the second transmission line 54a' extend parallel to each other. The edges 62' and the second edges 62a' extend along lines which intersect at a point, P, between the transmission line 54' and the second transmission line 54a'. The power divider/combiner 70 has a pair of output/input ports 80, 82 and an input/output port 84. A signal fed to the input/output port 84 appearing in phase quadrature between the pair of output/input ports 80, 82, and visa versa under principles of reciprocity. The pair of output/input ports 80, 82 are coupled to transmission line 54' and the second transmission line 54a', respectively, as shown.

Thus, referring again to FIG. 2, the patches 60a are not disposed about the longitudinal axis of the transmission line 54 but rather are entirely to one side of the transmission line, as shown. With the radiation formed to one side of the transmission line 54, a second discontinuity with orthognal polarization can be placed on the other side of the transmission line 54 by patches 60b, as shown in FIG. 2. Here, the second patches 60b are displaced, S, along the transmission line 54 by $\lambda/4$ (where $\lambda$ is the nominal operating wavelength of the antenna element) along the longitudinal axis of the transmission line 54, as noted above. Each pair of patches 60a, 60b thus form a series fed, circularly polarized radiator patches 60. The coupling to the radiation field is controlled by the width of the patches 60a, 60b, and phase control is achieved by controlling the patch length, L.

Figure 3:
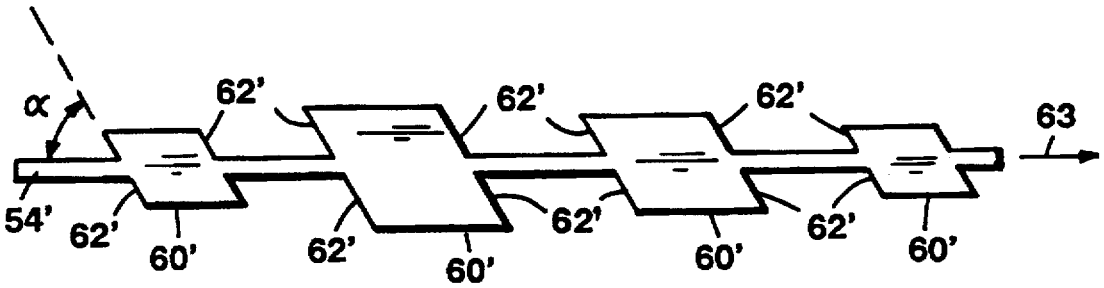
FIG. 3 is a plan view of strip conductor circuitry forming one element of an array of antenna elements according to an alternative embodiment of the invention and adapted for use in the antenna of FIGS. 1A and 1B.

Thus, in FIGS. 2, 3 and 4, the patches 60a, 60b, 60', 60a' are rhomboidal conductive patches disposed serially along, and integrally formed with, the strip transmission line 54, 54', 54a', as shown. The patches are formed on a surface of the solid material as a single layer of conductive material.

Figure 5:
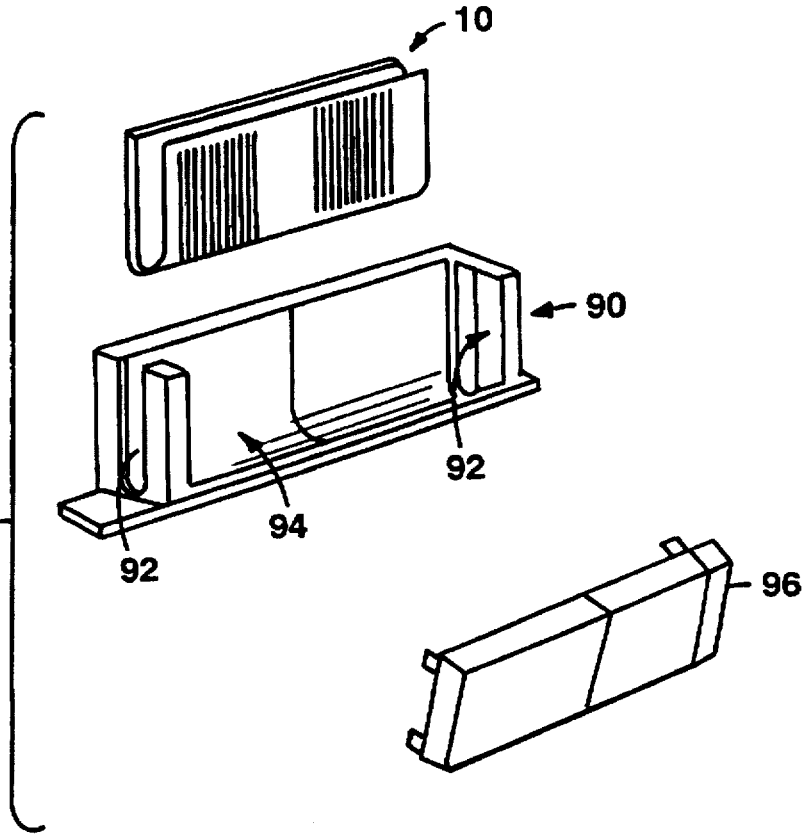
FIG. 5 is an exploded, isometric sketch of the antenna of FIGS. 1A and 1B together with a housing and radome for such antenna.

Referring now to FIG. 5, a package 90 for the antenna 10 (FIGS. 1A, 1B). Package 90 has a slot 92 for receiving the U-shaped antenna 10. The front portion 94 of the package 90 is open and adapted for a snap-on radome 96. The radome 96 faces the front portion of the antenna 10, i.e., the array of antenna elements 16 (FIGS. 1A, 1B).

Figure 6B:
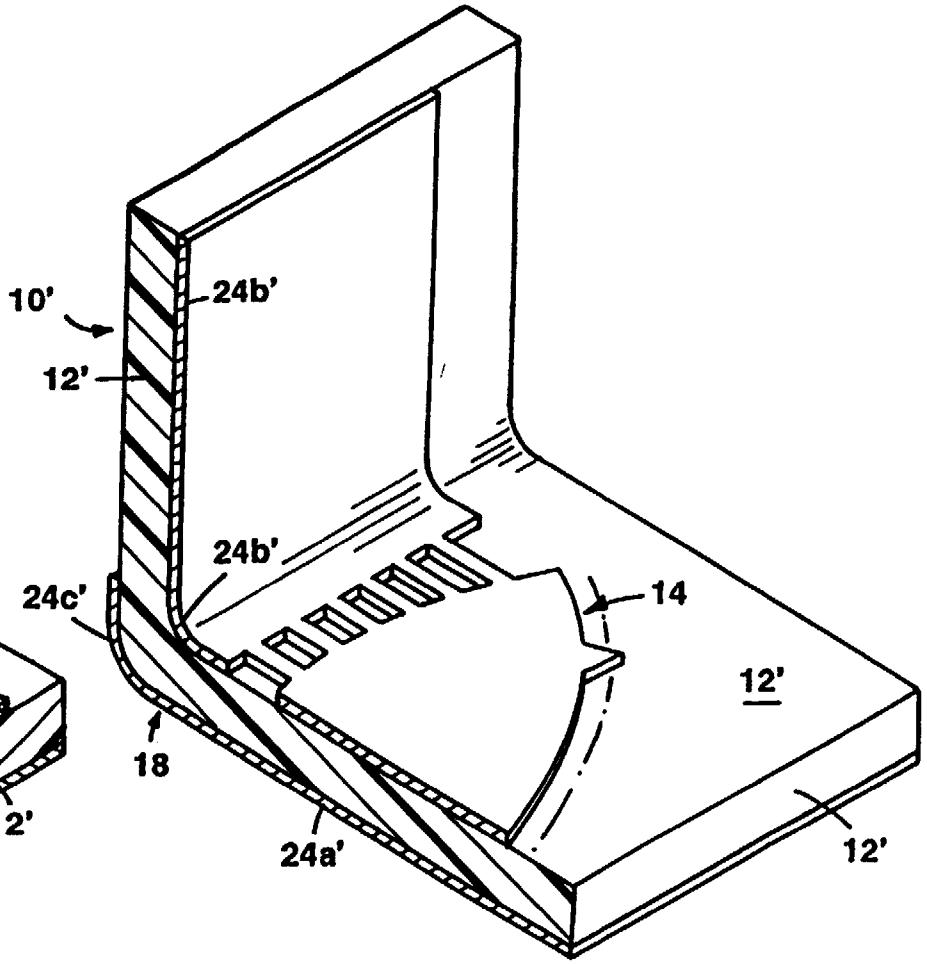
FIG. 6B is a isometric, cross-sectional sketch of the antenna of FIG. 6A from a front perspective of such antenna.
Figure 6A:
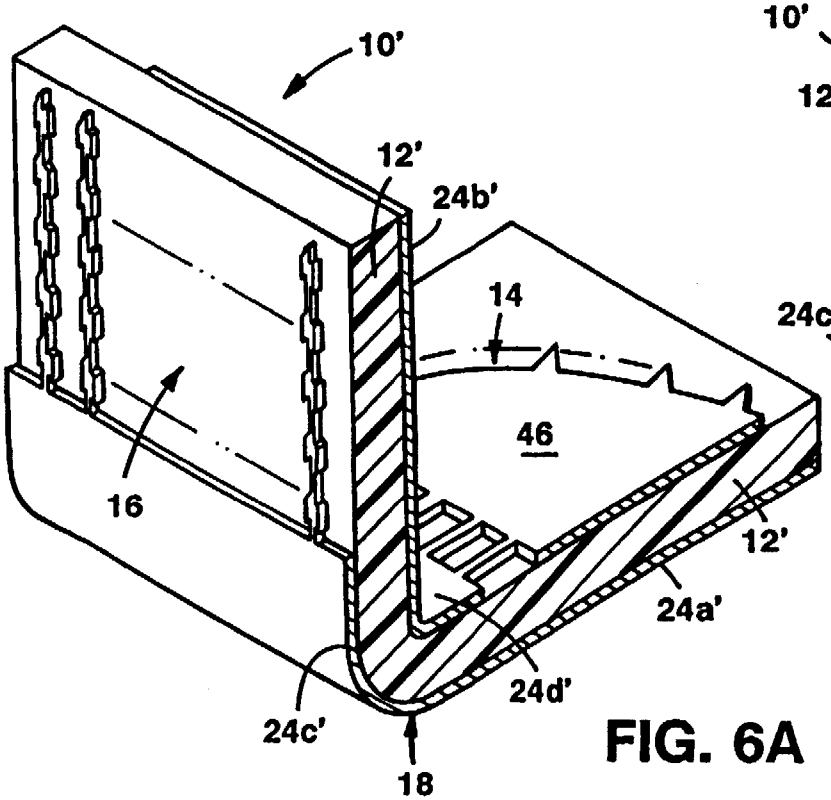
FIG. 6A is a isometric, cross-sectional sketch from a rear perspective of an antenna according to an alternative embodiment of the invention.

Referring now to FIGS. 6A, 6B, an L-shaped dielectric substrate is provided for the antenna 10'. Thus, here again, the antenna 10' includes: a beam forming network 14; an array of antenna elements 16; and a parallel plate region 18 coupling the array of antenna elements 16 and the beam forming network 14, all formed on a common, folded dielectric substrate 12'. Here, however, the substrate 12' is, as noted above, L-shaped. The beam forming network 14 is again a microwave lens 40 as described above in connection with FIGS. 1A and 1B. The ground plane conductor 24a' of the beam forming network 14 and the ground plane conductor 24b' of the array of antenna elements 16 are disposed on opposite surfaces of the L-shaped substrate 12' and the strip conductor circuitry of the array of antenna elements 16 and the beam forming network are disposed on the opposite surfaces of the L-shaped substrate 12'. One portion of ground plane conductor 24b' provides one plate 24c' of the parallel plate region 18 and one portion of ground plane conductor 24a' provides the other plate for the parallel plate region 18.

It should be noted that in both antenna 10 (FIGS. 1A, 1B) and antenna 10" (FIG. 6A, 6B), a ground plane conductor is disposed between the feed network and the array of antenna elements.

What is claimed is:

1. An antenna comprising:

a beam forming network comprising strip conductor circuitry separated from a ground plane conductor by a portion of dielectric substrate:

an array of antenna elements comprising strip conductor circuitry separated from a ground plane conductor by a second portion of the dielectric substrate; and a parallel plate region coupling the array of antenna elements and the beam forming network, such parallel plate region disposed about a folded region of the substrate and comprising a pair of conductive plates separated by the folded region of the dielectric substrate.

2. The antenna recited in claim 1 wherein the beam forming network comprises a microwave lens having a plurality of array ports disposed along one edge thereof and a plurality of beam ports disposed along an opposite edge of the lens, each one of the beam ports being associated with a differently directed one of a plurality of beams, the electrical lengths between each point on a wavefront of such beam, through the array of antenna elements, the parallel plate region and the microwave lens to the one of the beam ports associated therewith, being electrically equal to each other.

3. The antenna recited in claim 2 wherein the beam forming network includes a plurality of microstrip transmission lines coupling the array ports to one end of the parallel plate region.

4. The antenna recited in claim 3 wherein the array of antenna elements includes a plurality of microstrip transmission lines coupled to an opposite end of the parallel plate region.

5. The antenna recited in claim 4 wherein the substrate is L-shaped.

6. The antenna recited in claim 4 wherein the substrate is U-shaped.

7. The antenna recited in claim 6 wherein the ground plane conductors of the beam forming network and the array of antenna elements comprise a single conductor disposed on the inner surface of the U-shaped substrate and the strip conductor circuitry of the antenna elements and the beam forming network are disposed on the outer surface of the U-shaped substrate.

8. The antenna recited in claim 7 wherein the ground conductor provides one of the plates for the parallel plate region.

9. The antenna recited in claim 6 wherein the ground plane conductor of the beam forming network and the ground plane conductor of the array of antenna elements are disposed on opposite surfaces of the L-shaped substrate and the strip conductor circuitry of the antenna elements and the beam forming network are disposed on the opposite surfaces of the L-shaped substrate.

10. The antenna recited in claim 9 wherein the ground plane conductor is disposed between the feed network and the array of antenna elements.

11. An antenna, comprising:

a folded dielectric substrate;

a beam forming network comprising strip conductor circuitry separated from a ground plane conductor by a portion of the substrate;

an array of antenna elements comprising strip conductor circuitry separate from a ground plane conductor by a second portion of the substrate; and, a parallel plate region disposed about a folded region of the substrate, such parallel plate region comprising a pair of conductive plates separated by the folded region of the substrate, the beam forming network and the array of antenna elements being coupled together through the parallel plate region.

12. The antenna recited in claim 11 wherein the strip conductor circuitry of the beam forming network and the array of antenna elements, the ground plane conductors thereof and the pair of conductive plates of the parallel plate region are disposed on the substrate.

13. The antenna recited in claim 12 wherein the beam forming network is a microwave lens having a plurality of array ports disposed along one edge thereof and a plurality of beam ports disposed along an opposite edge of the lens, each one of the beam ports being associated with a differently directed one of a plurality of beams, the electrical lengths between each point on a wavefront of such beam, through the array of antenna elements, the parallel plate region and the microwave lens to the one of the beam ports associated therewith, being electrically equal to each other.

14. The antenna recited in claim 13 wherein the beam forming network includes a plurality of microstrip transmission lines coupling the array ports to one end of the parallel plate region and wherein the array of antenna elements includes a plurality of microstrip transmission lines coupled to an opposite end of the parallel plate region.

15. The antenna recited in claim 14 wherein substrate is a U-shaped substrate.

16. The antenna recited in claim 15 wherein the ground plane conductors of the beam forming network and the array of antenna elements comprise a single conductor disposed on the inner surface of the U-shaped substrate and wherein the strip conductor circuitry of the antenna elements and the beam forming network are disposed on the outer surface of the U-shaped substrate.

17. The antenna recited in claim 14 wherein the substrate is an L-shaped substrate.

18. The antenna recited in claim 17 wherein the ground plane conductor of the beam forming network and the ground plane conductor of the array of antenna elements are disposed on opposite surfaces of the L-shaped substrate and wherein the strip conductor circuitry of the antenna elements and the beam forming network are disposed on the opposite surfaces of the L-shaped substrate.

19. A microwave lens antenna, comprising:

a microwave lens element;

an antenna element;

a ground plane conductor disposed between the microwave lens element and the antenna element;

a dielectric member having disposed thereon the ground plane conductor, the microwave lens element, and the antenna element.

20. The microwave lens antenna recited in claim 19 wherein the parallel plate region comprises: a portion of the ground plane conductor; and, a second conductor disposed on a second, opposite surface of the substrate, the ground plane conductor providing a ground plane for the array of antenna elements and portions of the second conductor providing a ground plane for the microwave lens element.

21. An antenna, comprising:

a U-shaped dielectric member;

a ground plane conductor disposed on inner, facing surface portions of the U-shaped dielectric support member;

a microwave lens element disposed on an outer surface portion of a first arm of the U-shaped dielectric member, a portion of the second surface of the first dielectric member, such microwave lens element, first dielectric member and the first portion of the ground plane conductor disposed comprising a microwave lens; and an antenna element disposed on the outer surface portion of the other arm of the U-shaped dielectric member.

22. The antenna recited in claim 21 including a coupling structure comprising a U-shaped conductive member disposed on an outer surface portion of the base of the U-shaped dielectric member, opposing edge portions of the conductive member being disposed on the outer portions of the legs and being connected to the antenna element microwave lens element, respectively.

23. The lens and antenna aperture recited in claim 22 including a plurality of antenna elements disposed in an array on the outer surface of the arm portion of the U-shaped dielectric member, and wherein the conductive member, and the opposing edges thereof being disposed in the same direction as the array.

24. The antenna recited in claim 23 wherein the microwave lens element includes a lens shaped region, a plurality of feed ports disposed along one edge of the lens shaped region and an array of lens ports disposed along an opposing edge of the lens shaped region.

25. The antenna recited in claim 24 including a plurality of electrical conductors, one end of the conductors being connected to a corresponding one of the lens ports and the other end being connected to the conductive member at a first one of the opposing edges thereof.

26. The antenna recited in claim 25 including a second plurality of electrical conductors, one end of the conductors being connected to a corresponding one of the plurality of antenna elements and the other end being connected to the conductive member at a second one of the opposing edges thereof.

27. The antenna recited in claim 26 wherein such antenna is adapted to produce a plurality of differently directed, simultaneously existing beams, each one of the beams being associated with a corresponding one of the plurality of feed ports, the electrical lengths from points along a wavefront of one of such beams, through the array of antenna elements, electrical conductors, conductive member and microwave lens to the one of the feed ports corresponding to such one of the beams being equal.

28. An antenna, comprising:

a dielectric support structure having:

a pair of dielectric members extending in laterally displaced planes, each dielectric member having opposing, first and second surfaces, the first surface of a first one of the members facing the first surface of a second one of the dielectric members;

a ground plane conductor having a first portion thereof disposed on the first surface of the first dielectric member and a second portion thereof disposed on the first surface of the second dielectric member;

a microwave lens element disposed on the second surface of the first dielectric member, such microwave lens element, first dielectric member and the first portion of the ground plane conductor comprising a microwave lens; and an antenna element disposed on the second surface of the second dielectric member, such antenna element and the portion of the second portion of the ground plane comprising an antenna aperture.

29. An antenna, comprising;

a microwave lens, comprising:

a first dielectric member having opposing, first and second surfaces;

a first ground plane conductor section disposed on the first surface of the first dielectric member;

a microwave lens element disposed on the second surface of the first dielectric member;

an antenna aperture electrically coupled to the microwave lens, comprising:

a second dielectric member, the first and second dielectric members extending in laterally displaced planes, the second dielectric member having opposing, first and second surfaces, the first surface of a first one of the members facing the first surface of a second one of the dielectric members; and an antenna element disposed on the second surface of the second dielectric member;

a second ground plane conductor disposed on the second surface of the first dielectric member; and, wherein the first and second dielectric members extend in laterally displaced planes with the first and second ground plane sections being disposed between the microwave lens element and the antenna element.

30. An antenna, comprising;

a microwave lens, comprising:

a first dielectric member having opposing, first and second surfaces;

a first ground plane conductor section disposed on the first surface of the first dielectric member;

a microwave lens element disposed on the second surface of the first dielectric member;

an antenna aperture electrically coupled to the microwave lens, comprising:

a second dielectric member, the first and second dielectric members extending in laterally displaced planes, the second dielectric member having opposing, first and second surfaces, the first surface of a first one of the members facing the first surface of a second one of the dielectric members; and an antenna element disposed on the second surface of the second dielectric member;

a second ground plane conductor disposed on the second surface of the first dielectric member; and, wherein the first and second ground plane sections are disposed between the microwave lens element and the antenna element.

* * * * *